US008995704B2

(12) United States Patent
Huang et al.

(10) Patent No.: US 8,995,704 B2
(45) Date of Patent: Mar. 31, 2015

(54) MICRO-SPEAKER

(75) Inventors: Xing-zhi Huang, Shenzhen (CN); Li-zhu Xi, Shenzhen (CN); Xiong Zhang, Shenzhen (CN)

(73) Assignees: AAC Acoustic Technologies (Shenzhen) Co., Ltd., Shenzhen (CN); AAC Technologies Holdings, Inc., Grand Cayman (KY)

( * ) Notice: Subject to any disclaimer, the term of this patent is extended or adjusted under 35 U.S.C. 154(b) by 101 days.

(21) Appl. No.: 13/548,606

(22) Filed: Jul. 13, 2012

(65) Prior Publication Data

US 2013/0016874 A1 Jan. 17, 2013

(30) Foreign Application Priority Data

Jul. 15, 2011 (CN) ..... 2011 2 0249362 U

(51) Int. Cl.
*H04R 25/00* (2006.01)
*H04R 9/04* (2006.01)

(52) U.S. Cl.
CPC ..... *H04R 9/043* (2013.01)
USPC ..... 381/404; 381/396; 381/398; 381/405; 381/412; 181/171; 181/172

(58) Field of Classification Search
USPC ..... 381/433, 398, 399, 408, 409, 431, 423, 381/414, 420, 403, 404, 405, 396; 181/171, 181/172
See application file for complete search history.

(56) References Cited

U.S. PATENT DOCUMENTS

| | | | | |
|---|---|---|---|---|
| 8,155,374 | B2 * | 4/2012 | Yuasa et al. | 381/412 |
| 8,290,199 | B2 * | 10/2012 | Pircaro | 381/398 |
| 8,300,876 | B2 * | 10/2012 | Xu | 381/433 |
| 8,311,263 | B2 * | 11/2012 | Huang | 381/404 |
| 8,379,907 | B2 * | 2/2013 | Yan | 381/429 |
| 8,577,075 | B2 * | 11/2013 | Yan | 381/407 |
| 2004/0218779 | A1 * | 11/2004 | Fukuyama et al. | 381/409 |
| 2011/0311093 | A1 * | 12/2011 | He | 381/410 |

* cited by examiner

*Primary Examiner* — Davetta W Goins
*Assistant Examiner* — Jasmine Pritchard
(74) *Attorney, Agent, or Firm* — Anova Law Group, PLLC

(57) ABSTRACT

A micro-speaker includes a frame, a diaphragm mounted on the frame, a magnetic system received in the frame and defining a magnetic gap, a voice coil driving the diaphragm and suspended in the magnetic gap, and a suspension having a body portion and at least a pair of connecting portion extending from the body portion and mounted on the frame. The body portion of the suspension connects with the voice coil and far away from the diaphragm for cooperating with the diaphragm to fix the coil firmly, thereby ensuring the vibrating of the diaphragm is stable and balanced.

8 Claims, 3 Drawing Sheets

MICRO-SPEAKER

FIELD OF THE INVENTION

The present disclosure relates to the art of speakers and, particularly to a micro-speaker having a suspension attached on a coil.

DESCRIPTION OF RELATED ART

With the continuing development of audio and sound technology, micro-speakers have been widely used in electronic devices, such as cellular phones, PDAs (personal digital assistants), and so on.

A micro-speaker related to the present invention includes a case having a sound hole, a frame attached to the case for forming a chamber together with the case, a magnetic circuit system received in the chamber and having a magnetic gap, a diaphragm mounted on the frame, and a voice coil attached to a lower surface of the diaphragm and suspended in the magnetic gap. The voice coil has a body attached to the lower surface of the diaphragm and a pair of leading wires drawn out from the body and suspended in the chamber. While electrified, the voice coil will be activated to vibrate by the electromagnetic Ampere Force and further drives the diaphragm to vibrate, which converts the electrical signals to sound waves.

However, the leading wires of the voice coil are suspended in the chamber. When the vibrating amplitude of the voice coil is enhanced, the leading wires will meet the frame. As the result, the leading wires will be broken. In another hands, only one end of the voice coil is fixed by the diaphragm, so that the vibration of the diaphragm introduces unbalanced when the vibrating amplitude the voice coil is enhanced.

Therefore, it is desirable to provide a micro-speaker which can overcome the above-mentioned problems.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Figure 1:
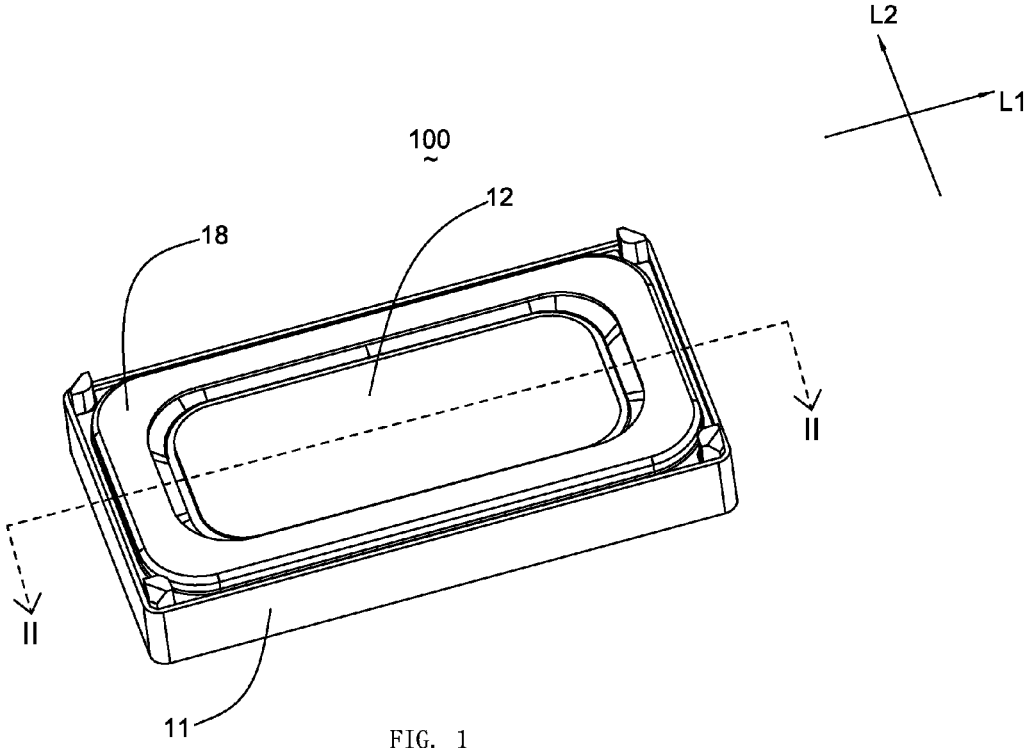
FIG. 1 is an illustrative assembly view of a micro-speaker according to a first exemplary embodiment of the present invention.
Figure 2:
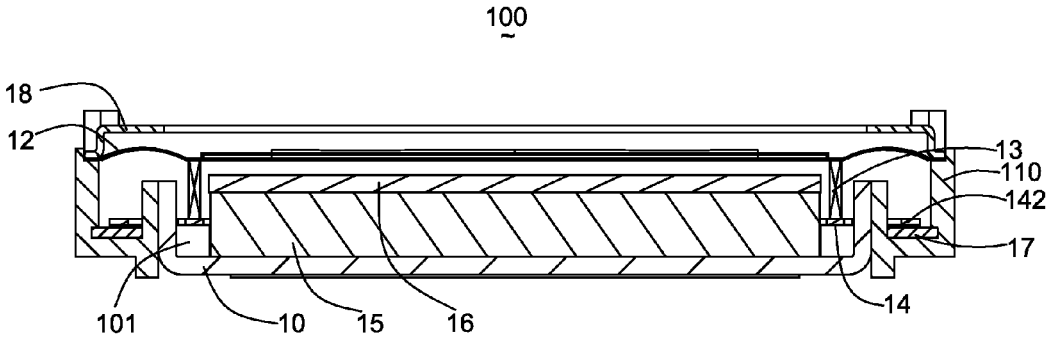
FIG. 2 is a cross-sectional view of the micro-speaker taken along line II-II of FIG. 1.
Figure 3:
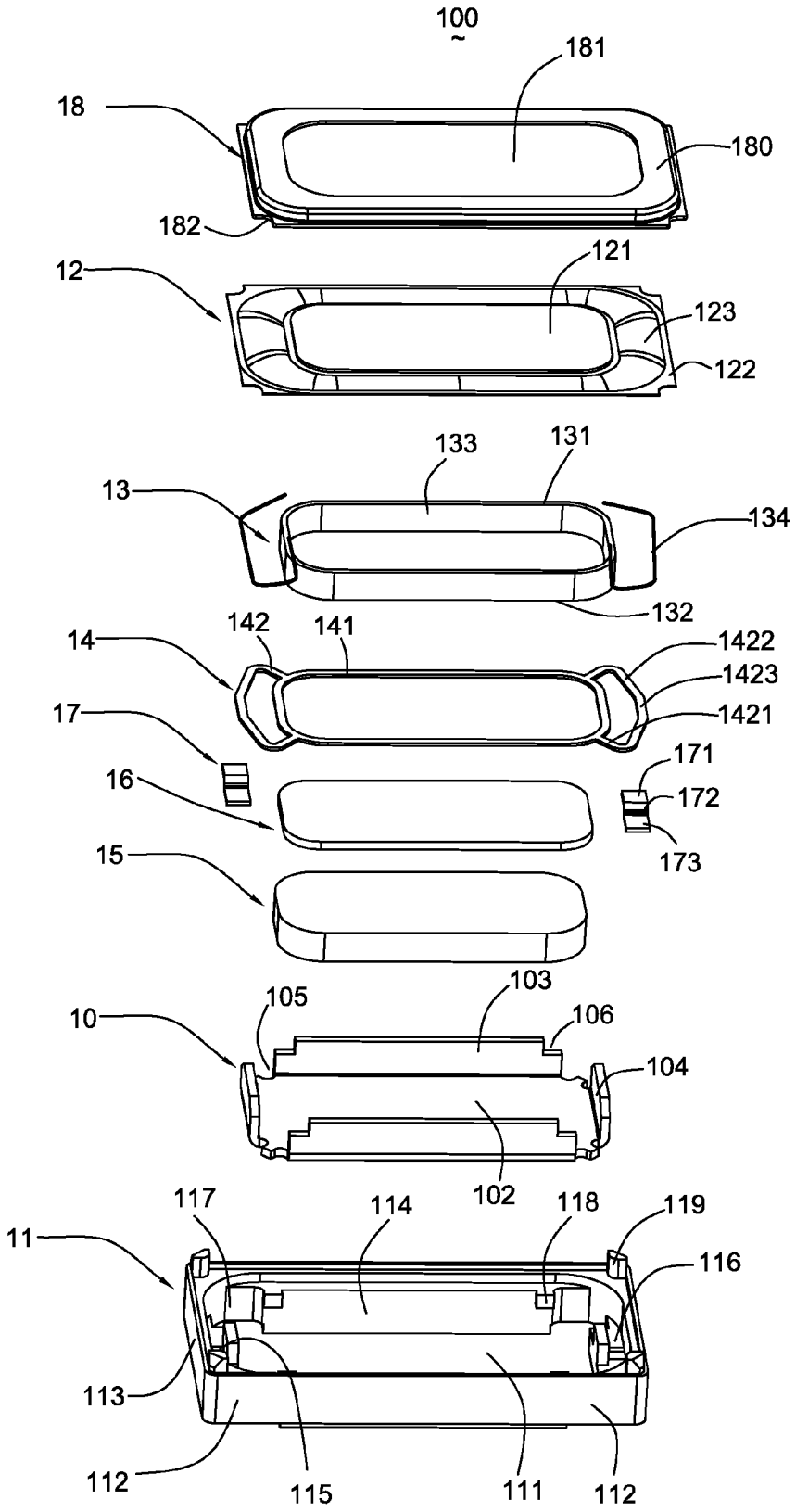
FIG. 3 is an illustrative exploded view of the micro-speaker of FIG. 1.

Referring to FIGS. 1-3, a micro-speaker 100, according to a first exemplary embodiment, includes a frame 11, a diaphragm 12 mounted on the frame 11, a magnetic system received in the frame 11 and defining a magnetic gap 101, a voice coil 13 attached to the diaphragm 12 for driving the diaphragm 12 and suspended in the magnetic gap 101, a suspension 14 mounted on the frame 11 and assembled on the voice coil 13, a pair of contacts 17 coupled with the suspension 14 for providing electrical signals to the voice coil 13, and a case 18 covering a periphery of the diaphragm 12. The micro-speaker 100 has a longitudinal direction L1 and a lateral direction L2 perpendicular to the longitudinal direction L1.

Referring to FIGS. 2 and 3, the frame 11 includes a base portion 110 and a receiving room 111 surrounded by the base portion 110. The base portion 110 has a pair of longitudinal sidewalls 112, a pair of lateral sidewalls 113 connected with the adjacent longitudinal sidewalls 112, a pair of longitudinal engaging portions 114 extending from the longitudinal sidewalls 112 towards the receiving room 111, a pair of lateral engaging portions 115 extending from the lateral sidewalls 113 towards the receiving room 111 for engaging with the magnetic system together with the longitudinal engaging portions 114, and at least a pair of slots 116 extending from an upper surface of the lateral engaging portions 115 towards a lower surface of the lateral engaging portions 115 for fixing the suspension 14, respectively. Each longitudinal engaging portion 114 is unconnected with the adjacent lateral engaging portions 115 for forming a plurality of leakage channels 117. Each longitudinal engaging portion 114 has a pair of engaging bars 118 extending from two ends thereof for fixing the magnetic system on the frame 11 firmly. The frame 11 further has four semi-columned protrusions 119 extending upwardly and perpendicularly from an upper surface of the base portion 110 for engaging with the case 18.

Referring to FIGS. 2 and 3, the voice coil 13 has a first end 131 connected with the diaphragm 12, a second end 132 opposite to the first end 131 and suspended in the magnetic gaps 101, a connecting sidewall 133 connecting the first and second ends 131, 132, and a pair of leading wires 134 drawn out from the first end 131. In fact, the voice coil can be directly connected to the diaphragm, and can also be connected to the diaphragm via a medium.

Referring to FIGS. 1-3, the magnetic system is received in the receiving room 111 and engaged with the longitudinal and lateral engaging portions 114, 115. The magnetic system has a yoke 10, a magnet 15 received in the yoke 10 and a pole plate 16 attached to an upper surface of the magnet 15. The yoke 10 has a bottom 102, a pair of longitudinal side portions 103 extending upwardly and perpendicularly from the bottom 102 in the longitudinal direction L1, and a pair of lateral side portions 104 extending upwardly and perpendicularly from the bottom 102 in the lateral direction L2. The longitudinal side portions 102 are unconnected with the lateral side portions 104, thereby forming four corners 105 for communicating with the leakage channels 117 to adjust the interior sound pressure of the micro-speaker 100. Each longitudinal side portion 103 has a pair of fixing holes 106 for cooperatively engaging with the fixing bars 118 of the frame 11, thereby fixing the yoke 10 on the frame 11 firmly.

Figure 4:
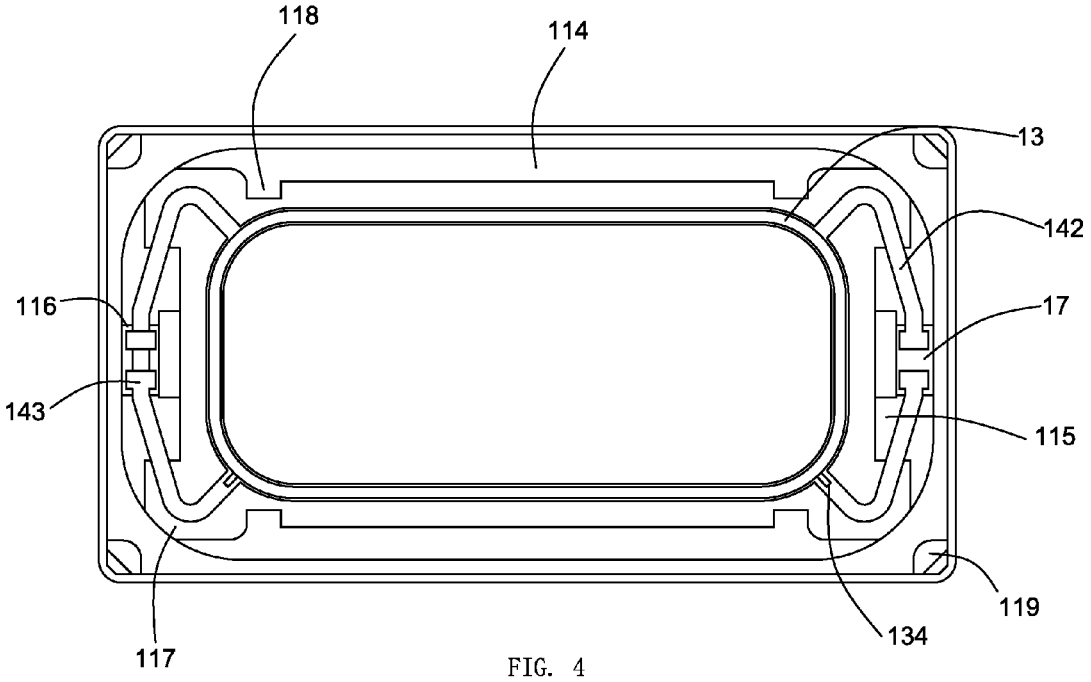
FIG. 4 is an illustrative top view of the micro-speaker of the FIG. 1, a diaphragm, a magnetic system and a cover thereof being removed away.

Referring to FIGS. 2-4, the suspension 14 comprises a circle body portion 141 connected with the second end 132 of the voice coil 13 and at least a pair of connecting portions 142 protruded outwardly from the circumference of two ends of the body portion 141. Each connecting portion 142 has a pair of protruding arms 1421 protruded outwardly from the circumference of one end of the body portion 141 and separated from each other, a pair of bending arms 1422 extending from each protruding arm 1421 and towards each other, and a pair of fixing arms 1423 connected with the corresponding bending arms 1422 and separated from each other. The body portion 141 is coplanar with respect to the connecting portions 142 for ensuring the vibrating of the diaphragm 12 is stable and balanced.

Referring to FIGS. 2-4, the pair of contacts 17 is received in the frame 11. Each contact 17 has a contacting portion 171 coupled with the corresponding fixing arm 1423 of the connecting portion 142 of the suspension 14, a holding portion 172 extending downwardly from the contacting portion 171 and received in the frame 11, and a soldering portion 173 extending from the holding portion 172 and exposed from the frame 11 for coupled with exterior electrical signals. The contacting portions 17 are parallel to the soldering portions 173.

Referring to FIGS. 2-4, when assembled, the fixing arms 1423 are fixed and inserted in the slots 116 and the protruding arms 1421 and the bending arms 1422 are suspended in the receiving room 111 of the frame 11 for ensuring the vibration of the voice coil 13. The leading wires 134 are fixed and coupled with the suspension 14 and the pair of contacts 17 are received in the frame 11 and connected the exterior electrical signals to the suspension 14, thereby providing electrical signals to the voice coil 13.

Referring to FIG. 3, the diaphragm 12 includes a central area 121 in the center thereof, a jointing area 122 at an outer periphery thereof, and a connecting area 123 between the central area 121 and the jointing area 122. The central area 121, the jointing area 122 and the connecting area 123 are coaxial with the suspension 14 and the magnetic system 12. The connecting area 113 is curved upwardly or downwardly to form an annular bugle or concave. In fact, the jointing area 122 is the periphery covered by the case 18, as mentioned above.

Referring to FIG. 3, the case 18 attaches onto the frame 10 to cover the jointing area 122 of the diaphragm 11. The case 18 includes a base 180, and a sound outlet 181 formed in the center of the base 180. The base 180 has four semi-columned recesses 182 at the four corners thereof to engage with the corresponding semi-columned protrusions 119 of the frame 11, thereby the mechanical connection between the frame 11 and the case 18 is obtained and secured. Sound generated by the micro-speaker 100 is transmitted to the outside of the micro-speaker 100 through the sound outlet 191.

Figure 5:
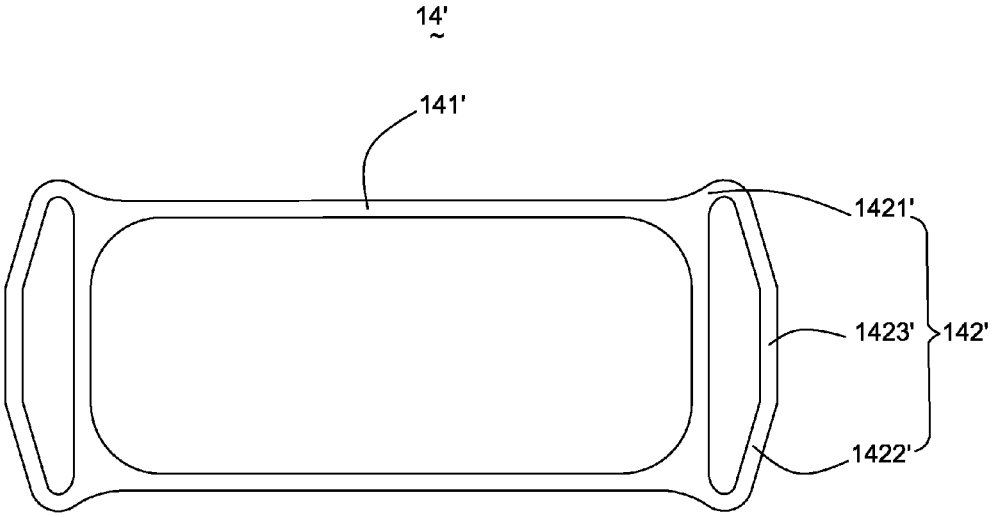
FIG. 5 is an illustrative top view of a suspension of a micro-speaker according to a second exemplary embodiment of the present invention.

Referring to FIG. 5, the second embodiment of the present invention is similar to the first embodiment of the present invention except that the structure of a suspension of a micro-speaker. The suspension has a circle body portion 141' and at least a pair of connecting portions 142' protruded outwardly from the circumference of two ends of the body portion 141'. Each connecting portion 142' has a pair of protruding arms 1421' protruded outwardly from the circumference of one end of the body portion 141' and separated from each other, a pair of bending arms 1422' extending from each protruding arm 1421' and towards each other, and a fixing arm 1423 connecting the pair of bending arms 1422'. The body portion 141' is coplanar with respect to the connecting portions 142'. In this embodiment, each connecting portion cooperates with the corresponding outer periphery of the body portion for forming a closed curve for improving the manufacturing efficiency of the suspension.

According to the micro-speaker, the suspension connects with the second end of the coil for limiting the vibrating of the voice coil and preventing the excessive amplitude of the voice coil. The leading wires are fixed on the suspension for preventing the broken of the leading wires when the vibrating amplitude of the voice coil is enhanced. The diaphragm cooperates with the suspension for fixing the coil firmly, thereby ensuring the vibrating of the diaphragm is stable and balanced.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker comprising:

a frame;

a diaphragm mounted on the frame;

a magnetic system received in the frame and having a magnetic gap;

a voice coil driving the diaphragm and suspended in the magnetic gap, the voice coil having a first end near the diaphragm and a second end opposite to the first end and far away from the diaphragm; and a suspension having a body portion connected with the second end of the voice coil and at least a pair of connecting portion extending from the body portion and mounted on the frame;

wherein each connecting portion has a pair of protruding arms protruded outwardly from the circumference of one end of the body portion and separated from each other, a pair of bending arms extending from each protruding arm and towards each other, and a pair of fixing arms connected with the corresponding bending arms and separated from each other; and wherein the pair of the bending arms is positioned between the pair of protruding arms and the pair of the fixing arms is positioned between the pair of the bending arms.

2. The micro-speaker as claimed in claim 1, wherein the voice coil has a pair of leading wires drawn out from the first end and fixed on the suspension.

3. The micro-speaker as claimed in claim 1 further has a pair of contacts received in the frame and electrically connected with the suspension for providing exterior electrical signals to the voice coil.

4. The micro-speaker as claimed in claim 1, wherein the protruding arms cooperates with the extending arms and the fixing arms form a closed circular body.

5. The micro-speaker as claimed in claim 1, wherein the body portion is coplanar with respect to the connecting portions for ensuring the vibrating of the diaphragm is stable and balanced.

6. The micro-speaker as claimed in claim 1, wherein the frame has a pair of longitudinal sidewalls, a pair of lateral sidewalls connected with the longitudinal sidewalls, a receiving room surrounding by the longitudinal sidewalls together with the lateral sidewalls, a pair of lateral engaging portions extending from the lateral sidewalls towards the receiving room for engaging with the magnetic system, and at least a slot provided on each lateral engaging portion for fixing the suspension, respectively.

7. The micro-speaker as claimed in claim 6, wherein the magnetic system has a yoke, the yoke has a plurality of corners, the frame further has a pair of longitudinal engaging portions extending from the longitudinal sidewalls towards the receiving room for engaging with the yoke and unconnected with the lateral engaging portions to form a plurality of leakage channels for communicating with the corners for adjusting an interior sound pressure of the micro-speaker.

8. The micro-speaker as claimed in claim 7, wherein each longitudinal engaging portion has a pair of engaging bar projecting from the longitudinal engaging portion towards the receiving room and the yoke has plurality of fixing holes for cooperatively engaging with the fixing bars of the frame for fixing the yoke on the frame firmly.

* * * * *